US006125756A

United States Patent [19]

Nüssel et al.

[11] Patent Number: 6,125,756

[45] Date of Patent: Oct. 3, 2000

[54] ERASABLE PRINTING PLATE HAVING A SMOOTH PORE FREE CERAMIC OR GLASS SURFACE

[75] Inventors: Barbara Nüssel, Stätzling; Hartmut Fuhrmann, Bobingen; Horst Dauer, Rohrbach; Josef Göttling, Friedberg, all of Germany

[73] Assignee: MAN Roland Druckmaschinen AG, Offenbach am Main, Germany

[21] Appl. No.: 09/166,375

[22] Filed: Oct. 5, 1998

Related U.S. Application Data

[60] Division of application No. 08/888,312, Jul. 14, 1997, Pat. No. 5,816,161, which is a continuation-in-part of application No. 08/506,200, Jul. 24, 1995, abandoned.

[30] Foreign Application Priority Data

Jul. 22, 1994 [DE] Germany ..... 44 26 012

[51] Int. Cl.[7] ..... B41N 1/14

[52] U.S. Cl. ..... 101/453; 101/455; 101/478

[58] Field of Search ..... 101/455, 463.1, 101/465–467, 478, 453

[56] References Cited

U.S. PATENT DOCUMENTS

| | | | |
|---|---|---|---|
| 3,675,572 | 7/1972 | Gosnell et al. | 101/467 |
| 4,846,065 | 7/1989 | Mayrhofer et al. | 101/467 |
| 4,991,501 | 2/1991 | Yokoyama et al. | 101/148 |
| 5,045,697 | 9/1991 | Schneider | 101/487 |
| 5,317,970 | 6/1994 | Nussel et al. | 101/467 |
| 5,382,964 | 1/1995 | Schneider | 101/467 |
| 5,440,987 | 8/1995 | Williams et al. | 101/454 |
| 5,454,318 | 10/1995 | Hirt et al. | 101/465 |
| 5,743,188 | 4/1998 | Ghosh et al. | 101/467 |
| 5,855,173 | 1/1999 | Chatterjee et al. | 101/467 |

FOREIGN PATENT DOCUMENTS

| | | |
|---|---|---|
| 0262475 | 4/1988 | European Pat. Off. . |
| 0523584 | 1/1993 | European Pat. Off. . |
| 0594097 | 4/1994 | European Pat. Off. . |
| 3633758 | 4/1988 | Germany . |
| 4123959 | 2/1993 | Germany . |
| 4235242 | 11/1993 | Germany . |
| 54-43922 | 4/1979 | Japan . |
| 56-150592 | 11/1981 | Japan . |
| 57-64597 | 4/1982 | Japan . |
| 1-228898 | 9/1989 | Japan . |
| 2-229092 | 9/1990 | Japan . |
| 6-47891 | 2/1994 | Japan . |
| 84/02494 | 7/1984 | WIPO . |

*Primary Examiner*—Stephen R. Funk
*Attorney, Agent, or Firm*—Cohen, Pontani, Lieberman & Pavane

[57] ABSTRACT

A printing plate which can be repeatedly directly provided with an image and erased and is suitable for a wet offset printing method. The printing plate has a smooth and pore-free surface which is hydrophilic or can be hydrophilized after being provided with an image. The printing plate contains no strong microdipoles and consists of a ceramic, a glass or a metal, in particular of a metal alloy. An erasing and hydrophilizing apparatus preferably integrated in the printing press, repeatedly erases and prepares, i.e. rehydrophilizes, the printing plate for a further image-providing and printing process.

7 Claims, 1 Drawing Sheet

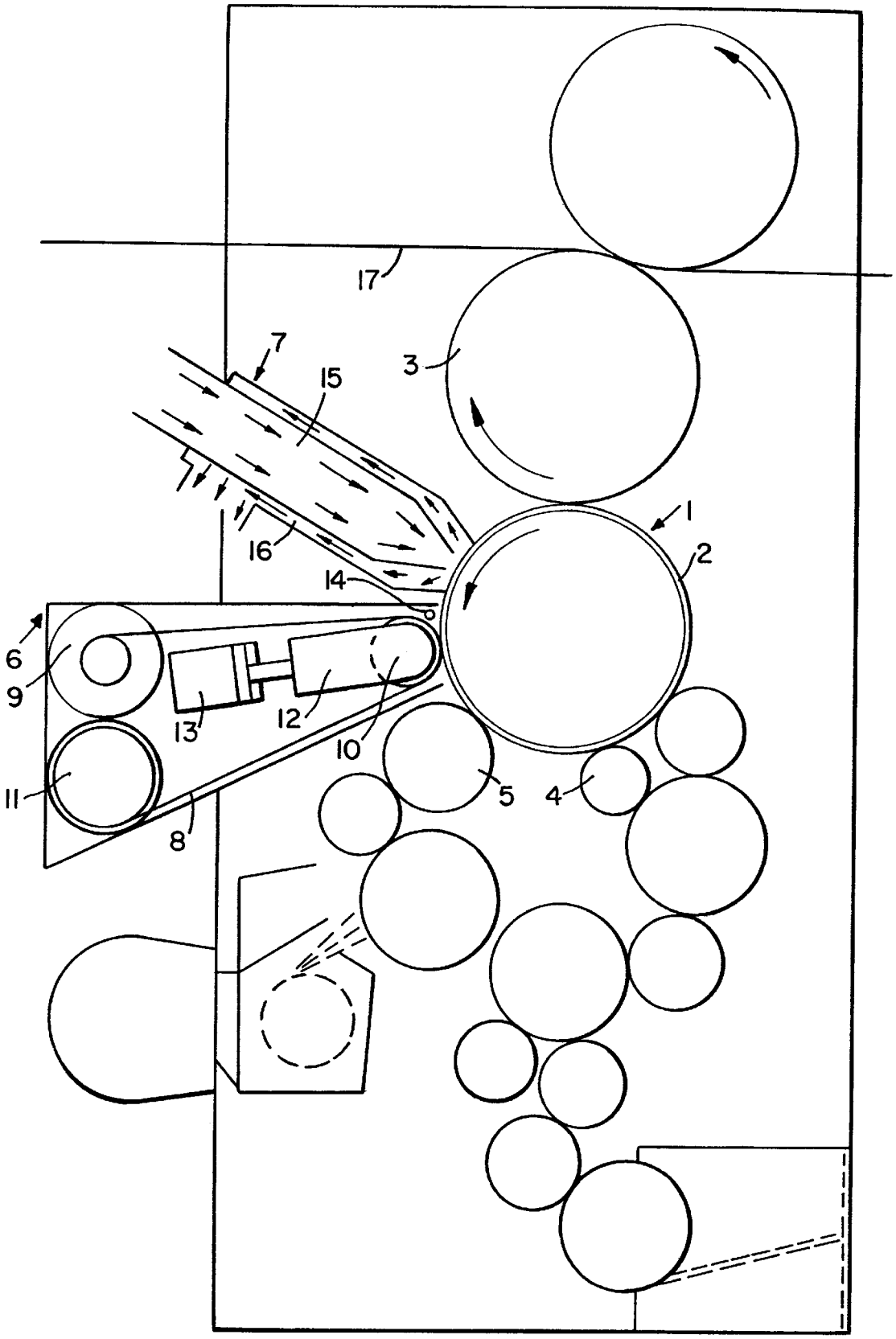
17
7
15
3
1
2
16
14
6
9
13
12
10
11
8
5
4

ERASABLE PRINTING PLATE HAVING A SMOOTH PORE FREE CERAMIC OR GLASS SURFACE

This is a divisional application of U.S. patent application Ser. No. 08/888,312 filed on Jul. 14, 1997, now U.S. Pat. No. 5,816,161, which is a Continuation-in-part of U.S. patent application Ser. No. 08/506,200, filed on Jul. 24, 1995, now abandoned.

BACKGROUND OF THE INVENTION

1. Field of the Invention

The invention relates to an erasable printing plate and to a process and an apparatus for erasing and regenerating the printing plate.

2. Discussion of the Prior Art

A printing plate suitable for the wet offset method is disclosed in DE 42 35 242 C1. This printing plate has strong microdipoles at least in its outer layer, and its surface is hydrophobic. After application of covering material corresponding to an image to be printed, the non-image parts are hydrophilized by a hydrophilizing agent. It is true that these printing plates have the advantage that they can readily be regenerated, i.e. after completion of a printing process they can be erased in a simple manner and provided with further images. However, these printing plates have the disadvantage that it is expensive to produce them.

Regeneration processes which are suitable for smooth as well as rough, porous printing plates of ceramic, glass or anodized aluminum are disclosed in DE 41 23 959 C 1. The disadvantage of these regeneration/erasing processes is that they are technically relatively complicated and expensive to carry out.

SUMMARY OF THE INVENTION

Accordingly, it is an object of the present invention to provide a printing plate which can be directly provided with images and repeatedly erased and which has the advantage of simpler production compared with known printing plates.

Pursuant to this object, one aspect of the present invention resides in a printing plate which has a pore-free and smooth surface with a roughness $R_a$ of less than 1 $\mu$m. The smooth surface is hydrophilic or can be hydrophilized and the plate material contains no strong microdipoles.

It is a further object of the invention to provide a process for repeatedly erasing and regenerating such a printing plate, which can be carried out within the printing press, without removal of the plate cylinder or of the printing plate.

Pursuant to this object, another aspect of the present invention resides in a process for erasing a print image on the printing plate, which process includes pressing a cleaning cloth against the surface of the printing plate using a pressure roller while the plate cylinder on which the printing plate is mounted slowly rotates. The cleaning cloth is unwound from a feed roller and is wound onto a wind-up roller either in a step wise manner or continuously. The pressure roller permits the contact pressure of the cleaning cloth against the plate cylinder to be varied. Additionally, nozzles supply cleaning solutions directly to the surface of the printing plate or to the cleaning cloth.

Another aspect of the present invention resides in a printing press which includes a plate cylinder on which the printing plate is mounted, and still further includes an erasing and hydrophilizing apparatus positionable at the plate cylinder for cleaning the printing plate and hydrophilizing the surface thereof.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The single FIGURE shows, in cross-section, a printing unit having an apparatus according to the invention for erasing and regenerating the printing plate according to the invention.

DETAILED DESCRIPTION OF THE PREFERRED EMBODIMENTS

For a printing plate to be capable of being readily erased, it must be smooth and pore-free. Hence, it must not contain cavities, at least not in its surface, and must not be rough, so that no mechanical anchoring occurs between the surface and the image-producing material, printing ink or dirt, which can no longer be removed once contained in the surface cavities. To accomplish this the surface roughness $R_a$ must be <1 $\mu$m. To ensure that the printing plates are suitable for the wet offset method, their surface must be either hydrophilic or easily capable of being rendered hydrophilic. The printing plate is hydrophilized by spraying a hydrophilizing agent, such as a plate cleaner, onto it, for example from nozzles. The hydrophilic character of the surface must be capable of being restored even after thermal stress or thermal cycling, i.e. after a thermal fixing step for material applied imagewise. Hence, the hydrophilic character must at most become reversibly weaker or disappear reversibly. Thermal cycling conventionally takes place in a temperature range of 100 to 500° C. The surface is subjected to a temperature in this range during erasing and fixing the printing plate for a sufficient period of time to accomplish the fixing or erasing. Those skilled in the art are aware of the time periods involved.

Suitable materials for the production of such printing plates are, for example, ceramics. The plates can be prepared by the sol-gel process, a PVD or a CVD process, in a thermal spray process, for example the plasma spray process, or by a sinter process. The ceramic must then be ground as smooth as glass, i.e. it may only have a roughness $R_a$ of <0.3 $\mu$m. If the printing plates produced in one of the stated processes are still not pore-free, they are subsequently sealed.

Ceramic printing plates contain, for example, alumina, aluminum silicate (mullite), zirconium silicate or zirconium oxide. It is particularly advantageous if the hydrophilic character of a ceramic printing plate not only is achieved by hydrophilizing the surface but is a volume property of the ceramic layer.

Instead of being produced from ceramic, printing plates having a smooth surface may also be produced from glass, preferably from a borosilicate-based glass which is resistant to chemicals and to heat.

Other materials for the production of the printing plates are metals, among which alloys having a good microstructural stability and high resistance to oxidation even during thermal cycling are particularly suitable with exception of alloys containing more than 50% aluminum. When used as printing plates, the metals have a smooth surface with a roughness $R_a$ of <0.2 $\mu$m.

Nickel chromium steels are particularly suitable for producing printing plates. Nickel-chromium-iron alloys and nickel-chromium-molybdenum alloys are preferably used, in particular the alloys obtainable from the company Heynes International Incorporated, Kokomo, USA, under the material numbers 2.4665 and 2.4819, 2.4602, 2.4636 and 2.4638, respectively. Other very suitable nickel-chromium-molybdenum and nickel-chromium-iron alloys are the alloys obtainable under the material numbers 2.4856 and 2.4851 from the company Huntington Alloy Product Division, Huntington, USA. The common feature of all these alloys is that, like the other alloys not named more specifically here, they have good resistance to the thermal cycling caused by the thermal fixing as well as good resistance to oxidation. Preferably, between 3 and 70% of alloy should be composed of steel, nickel, chromium, molybdenum, tungsten, niobium and aluminum.

After the end of the printing process, such a printing plate which has been directly provided with an image and consists of one of the above-mentioned materials, a ceramic, a glass, or a metal, or at least has a surface layer of one of these materials, can be erased within the printing press in the manner described next. First, the printing ink residues and the coating applied imagewise are removed, for example wiped off, by means of a cleaning agent. The cleaning agent is a solvent or solvent mixture that contains no solid components. In order to be able to remove even final and slight residues of the coating applied imagewise to the printing plate, which residues otherwise cause so-called ghost images, the surface of the printing plate is then mechanically rubbed. A polish-containing cleaning agent, for example a plate cleaner, as generally used for cleaning printing plates, serves for this purpose. The plate cleaner is then removed, for example with water, and the printing plate is rendered hydrophobic again by wetting with a solvent, in order to prepare it for a further direct-image-providing step. After provision of an image and fixing, the printing plate is hydrophilized again, as also disclosed, for example, in DE 42 35 242 C1, unless the material of the printing plate already has a hydrophilic surface and it is therefore sufficient if the non-image parts are hydrophilized again only by the fountain solution during the printing process.

The apparatus shown in the FIGURE is used both for erasing and for hydrophilizing and for fixing the printing plate described above, which is directly provided with an image, and other printing plates, as disclosed, for example, according to DE 41 23 959 C1 or DE 36 33 758 A1. The fixing step comprises heating the printing plate provided with an image to a surface temperature between 170° C. and 210° C. by means of a drier 7. Alternatively, the printing plate can be heated either inductively or by an infrared lamp. In other fixing processes, UV radiation or electron beams are used. It is also possible to cure the printing plates by suitable chemicals, for example merely by moisture.

The erasing and hydrophilizing apparatus is installed as a fixed unit in a printing unit of an offset printing press and is arranged on the circumference of a plate cylinder 1 having a printing plate 2 which can be directly provided with an image. A rubber blanket cylinder 3 for transferring the print image to a print medium, such as the print medium web 17 shown here, and rollers 4, 5 of an inking unit or of a damping unit rest against the plate cylinder 1.

An image-providing unit (not shown here) is likewise arranged on the circumference of the plate cylinder 1, for direct provision of an image.

The erasing and hydrophilizing apparatus has a cleaning apparatus 6 and the drier 7, which can be fed toward the printing plate 2 and moved away from it again. The cleaning apparatus 6 operates by means of a cleaning cloth or cleaning fleece 8, which passes from a feed roller 9 via a pressure roller 10 which presses the fleece 8 against the printing plate 2, and is then wound onto a wind-up roller 11.

The pressure roller 10 is in turn rotatably mounted in a vibrating head 12. The vibrating head 12 is pressed against the printing plate 2 by means of a pressure cylinder 13. Nozzles 14, which are present in front of the cleaning apparatus 6 in the direction of rotation of the plate cylinder 1, can apply a cleaning liquid or a cleaning paste, a hydrophilizing agent, for example a plate cleaner, or another agent which serves either for erasing the printed image applied to the printing plate 2 and for removing printing ink residues or for hydrophilizing the surface of the printing plate 2, to the printing plate. This agent, together with the dirt which it removes, can be taken up by the cleaning cloth 8 if the pressure cylinder 13 presses the pressure roller 10 against the printing plate 2 and the cleaning cloth 8 is moved past the printing plate 2. The nozzles 14 can preferably be adjusted with regard to their angle to spray the agent either directly onto the printing plate 2 or onto the cleaning cloth 8. The pressure roller 10 is, for example, rubber-coated. The cleaning cloth 8 is wound either in portions or continuously from the feed roller 9 onto the wind-up roller 11. Preferably, the pressure with which the cleaning cloth 8 is pressed against the printing plate 2 can also be varied.

The printing plate 2 cleaned by the cleaning apparatus 6 can then be dried by the drier 7, with hot air via a hot air supply apparatus 15 by reversing rotation of the plate cylinder 1 or moving the drier 7 behind the cleaning apparatus 6 in the illustrated rotational direction. The hot air flows subsequently, when it contains, for example, solvent residues, back through an extraction apparatus 16.

The erasing and hydrophilizing apparatus can, for example, be positioned alternately at the plate cylinder 1 or at the rubber blanket cylinder 3 if it is also intended to clean the rubber blanket by means of the erasing and hydrophilizing apparatus.

In another embodiment, the erasing and hydrophilizing apparatus is located outside the printing press, in order there to clean only printing plates 2 or rubber blankets.

The cleaning solutions used are solvents for removing the printing ink residues and the polymer layer applied imagewise, or other cleaning agents which contain abrasive media, such as, for example, some of the plate cleaners conventionally used in the graphics industry, or water for removing abrasive residues. The cleaning agents can be used one after the other in any desired sequence or in a changing sequence. Also, the printing plate surface to be erased can also be rubbed off with a dry cleaning cloth after or between the individual cleaning steps. In order to increase the efficiency of cleaning agents containing abrasive media, the cleaning cloth 8 preferably moves in a manner which changes.

The invention provides a printing plate 2 which has a normal electrochemical potential of >0 eV and can be repeatedly directly provided with an image and erased and is suitable for a wet offset printing method. It has a smooth and pore-free surface which is hydrophilic or can be hydrophilized after being provided with an image. The printing plate 2 contains no strong microdipoles and consists of a ceramic, a glass or a metal, in particular of a metal alloy. By means of an erasing and hydrophilizing apparatus 6, 7 preferably integrated in the printing press, the printing plate 2 can be repeatedly erased and prepared, i.e. rehydrophilized, for a further image-providing and printing process. The desired structural stability of the printing plate 2 is obtained by metals whose upper surface becomes passive through oxidation, i.e. NiO, $Cr_2O_3$, $MoO_3$ and $ZrO_2$.

The invention is not limited by the embodiments described above which are presented as examples only but can be modified in various ways within the scope of protection defined by the appended patent claims.

What is claimed is:

1. A printing plate which can be directly provided with an image and erased and is suitable for wet offset printing, wherein said plate is made of a surface selected from the group consisting of a ceramic having a surface roughness of $R_a$ of equal to or smaller than 0.3 $\mu$m and of glass which surface is pore-free and is at least one of hydrophilic and hydrophilizable, the plate also contains no strong microdipoles whereby the plate is erasable.

2. The printing plate as defined in claim 1, wherein the plate is a ceramic prepared by one of a sol-gel process, a PVD process, a CVD process and a thermal spray process.

3. The printing plate as defined in claim 1, wherein the plate is a sintered ceramic.

4. The printing plate as defined in claim 1, wherein the surface is sealed.

5. The printing plate as defined in claim 1, wherein the plate further includes at least one of alumina, aluminum silicate (mullite), zirconium silicate and zirconium oxide.

6. The printing plate as defined in claim 1, wherein the ceramic plate is hydrophilic throughout its volume.

7. The printing plate as defined in claim 1, wherein the plate is made of a borosilicate glass.

* * * * *